United States Patent [19]

Servadio

[11] Patent Number: 4,717,107

[45] Date of Patent: Jan. 5, 1988

[54] CLOTHESLINE LOCKING POLE

[76] Inventor: Robert Servadio, 3721 Parkview Ave., Pittsburgh, Pa. 15213

[21] Appl. No.: 39,173

[22] Filed: Apr. 17, 1987

[51] Int. Cl.[4] ..... E04G 25/00

[52] U.S. Cl. ..... 248/353; 24/132 R

[58] Field of Search ..... 248/353; 24/132 R, 132 AA, 24/509; 211/119.1, 119.01, 119.11

[56] References Cited

U.S. PATENT DOCUMENTS

| | | | |
|---|---|---|---|
| 1,786,533 | 12/1930 | Griner | 248/353 |
| 1,789,765 | 1/1931 | McKinney | 248/353 |
| 2,031,091 | 2/1936 | Berg | 248/353 |
| 2,546,157 | 3/1951 | Hume | 248/353 X |
| 2,560,150 | 7/1951 | Bateman | 248/353 |
| 2,618,455 | 11/1952 | Orthwin | 248/353 |
| 2,797,942 | 7/1957 | Schwalbe | 248/353 X |
| 3,357,126 | 12/1967 | Klieves | 24/132 R |

*Primary Examiner*—Ramon O. Ramirez

*Attorney, Agent, or Firm*—William J. Ruano

[57] ABSTRACT

A clothesline pole having a hollow to portion in which is pivotally mounted an alligator type clamp with jaw portions upright and which portion is slotted to receive the clothesline and lock it to the pole. It is held locked by a spring normally holding the jaws in clamped position. The handle portions of the clamp are accessible from the outside of the pole through a slot therein.

3 Claims, 3 Drawing Figures

CLOTHESLINE LOCKING POLE

This invention relates to a clothesline pole, more specifically, to a clothesline pole with a clothesline engaging means to secure the clothesline pole to the clothesline so as to prevent the clothesline pole from becoming disengaged from the clothesline due to a gust of wind.

BACKGROUND OF THE INVENTION

An outstanding disadvantage of conventional clothesline poles is that they do not embody an easy means for locking the clothesline pole onto the clothesline, thereby securing the clothesline pole to the clothesline to prevent disengagement of line and pole during a gust of wind.

SUMMARY OF THE INVENTION

An object of this invention is to provide a novel clothesline pole that is devoid of the above-mentioned disadvantage.

A more specific object of this invention is to provide a clothesline pole which is easily engaged and disengaged from a clothesline and which can be manufactured easily and relatively inexpensively.

DESCRIPTION OF THE PREFERRED EMBODIMENT

Figure 1:
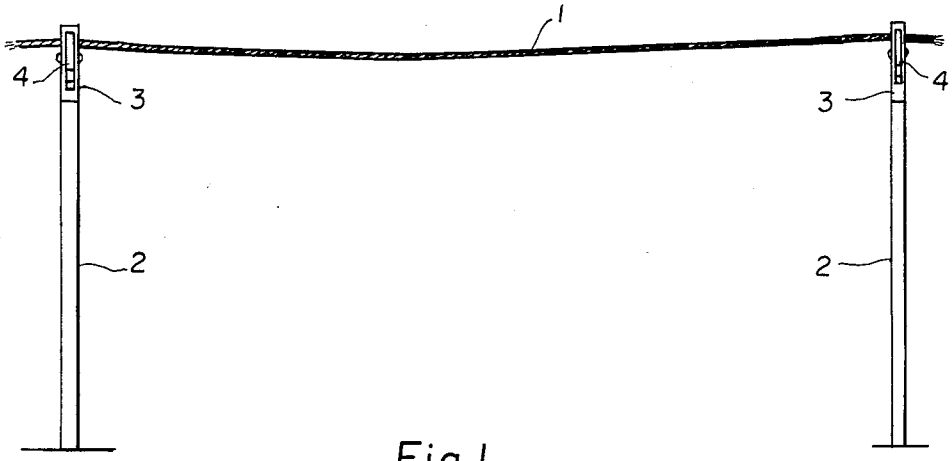
FIG. 1 is an elevational view of a pair of clothesline poles embodying my invention.
Figure 2:
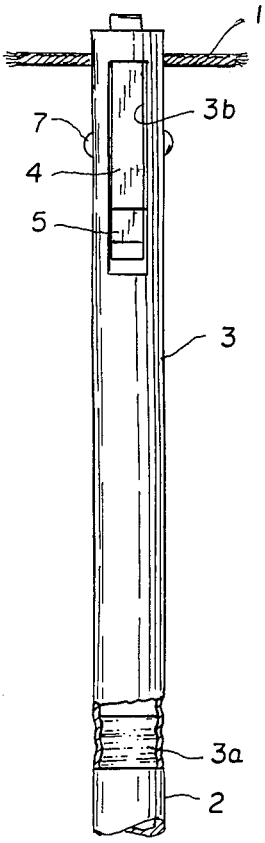
FIG. 2 is an enlarged elevational view of the upper portion of a pole shown partially cut away.
Figure 3:
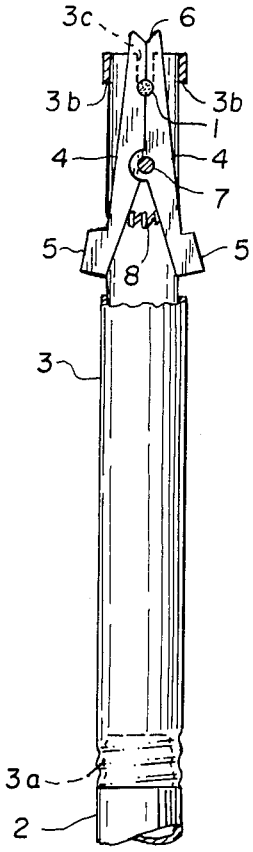
FIG. 3 is an enlarged and partially cut away elevational view of the upper portion of the clothesline pole taken from the right of FIG. 2 to more clearly show the line engaging means.

Referring to FIGS. 1 to 3, more particularly FIG. 1, numeral 1 denotes a clothesline being supported by a pair of composite poles 2,3. Numeral 4 denotes a clothesline engaging means whose construction will be described hereinafter, steadfastly engaging clothes line 1 to the composite poles 2,3.

Referring more particularly to FIGS. 2 and 3, numeral 3 denotes generally the upper portion of composite pole 2,3. Portion 3 screw-threadedly or telescopically fits into the lower portion 2, preferably of solid wood having an upward projection 3*a* of a smaller diameter presenting a shoulder on which the bottom of upper portion 3 rests so as to fit snugly into base portion 2. Portions 2 and 3 may be screw threaded together instead or made of one hollow continuous piece throughout. They may be made of metal, wood or plastic material, either hollow or solid. In addition, pole 3 is preferably hollow in construction and has two diametrically opposed rectangular cut outs as described by numerals 3*b*,3*b*. The purpose of these cut outs is to allow insertion and operation of the line engaging means 4.

At the top end of the pole 3 and located above and at right angles of rectangular cut outs as described by numerals 3*b*,3*b* are two U-shaped grooves 3*c*,3*c*. These grooves being diametrically opposed, allow passage of clothesline 1 through upper end of pole 3.

Numeral 4 denotes a spring actuated alligator type clamp or clothesline engaging means comprising first and second jaw elements in opposed relation which are pivotally connected together at their centers by pin 7 supported by pole 3. Said jaw elements each have a squeezable handle 5 which is operatively connected to said jaw elements for movement of the jaw elements in an opening direction away from each other to allow engagement of the clothesline.

Spring 8 is operatively connected to said handle elements so as to push the handle elements away from each other when pressure on handles is released, therefore causing said jaw elements to close securely around clothesline 1 so as to lock it to the pole 3.

Thus it will be seen that I have provided a clothesline assembly of inexpensive and simple construction which assures interlocking of the clothesline pole to the clothesline to prevent falling of clothes supported on the line as the result of gusts of wind.

I claim:

1. An article of the character described for the support and locking of a clothesline, said article comprising a clothesline pole, having two diametrically opposed rectangular openings near its top end, said rectangular openings allowing the insertion and operation of line engaging means, two- U-shaped groooves located at the top of said pole in opposite relationship and being at right angles of said rectangular openings, said grooves allowing the passage of said clothesline through the top of said pole so as to be engaged by said line engaging means, said line engaging means comprising an alligator type clamp pivotally connected to said pole at right angles to said rectangular openings and comprising two upper, opposing jaw elements operationally connected to two lower squeezable hand elements, said handle elements being squeezable through said rectangular openings from outside thereof which causes said jaws to open for engagement of said clotheslines, said handle elements having a return spring therebetween so as to return said jaws to the closed position when pressure on said handles is released, said spring being of sufficient strength as to keep said jaws firmly closed for locking of said clothesline to said pole.

2. The article recited in claim 1 wherein said clothesline pole has a top hollow cylindrical portion having a lower end which is slip-fitted to the top of said pole to enable easy attachment and detachment.

3. The article recited in claim 1 wherein said clothesline pole has a top hollow cylindrical portion having a lower end which is screw threadedly fitted to the top of said pole to enable easy attachment and detachment.

* * * * *